US010923298B1

(12) United States Patent
Chen

(10) Patent No.: US 10,923,298 B1
(45) Date of Patent: Feb. 16, 2021

(54) COMPACT POLE UNIT FOR FAST SWITCHES AND CIRCUIT BREAKERS

(71) Applicant: Eaton Intelligent Power Limited, Dublin (IE)

(72) Inventor: Steven Zhenghong Chen, Coraopolis, PA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/838,716

(22) Filed: Apr. 2, 2020

(51) Int. Cl.
*H01H 9/04* (2006.01)
*H01H 3/46* (2006.01)

(52) U.S. Cl.
CPC ..... *H01H 9/04* (2013.01); *H01H 3/46* (2013.01)

(58) Field of Classification Search
CPC ..... H01H 9/04; H01H 3/46; H01H 33/025; H01H 2033/028; H01H 33/42; H01H 33/66; H01H 33/6606; H01H 33/664; H01H 33/666; H01H 33/6662
USPC ..... 200/238
See application file for complete search history.

(56) References Cited

U.S. PATENT DOCUMENTS 4,250,363 A * 2/1981 Heberlein ..... H01H 33/664 218/123
7,910,852 B2 3/2011 Chen et al.
8,952,826 B2 2/2015 Leccia et al.
2016/0141126 A1* 5/2016 Kikuchi ..... C22C 1/0425 218/127
2020/0279709 A1* 9/2020 Chen ..... H01H 33/666

FOREIGN PATENT DOCUMENTS

EP 2549503 A1 1/2013

OTHER PUBLICATIONS

Bosworth et al. "High Speed Disconnect Switch with Piezoelectric Actuator for Medium Voltage Direct Current Grids" IEEE Electric Ship Technologies Symposium, pp. 419-423 (2015).
Peng et al. "A Fast Mechanical Switch for Medium Voltage Hybrid DC and AC Circuit Breakers" IEEE Transactions on Industry Applications 52(4)2911-2918 (2015).
Peng et al. "Evaluation of Design Variables in Thompson Coil Based Operating Mechanisms for Ultra-Fast Opening in Hybrid AC and DC Circuit Breakers" IEEE Applied Power Electronics Conference and Exposition, pp. 2325-2332 (2015).

(Continued)

*Primary Examiner* — Edwin A. Leon
*Assistant Examiner* — Lheiren Mae A Caroc
(74) *Attorney, Agent, or Firm* — Fox Rothschild LLP

(57) ABSTRACT

A circuit breaker includes a compact pole unit with an encapsulated body having ring(s) and conducting terminals that each extend from the encapsulated body. The body includes a vacuum interrupter and a coupler assembly that may be integrated into the pole unit. The coupler assembly includes a contact spring positioned an end of the compact pole unit, as well as a plunger that may be biased by the contact spring. The circuit breaker also includes an actuator positioned at the end of the pole unit that is opposite the coupler assembly. The circuit breaker also may include a second actuator that is will be connected to the contact spring of the coupler assembly via the plunger, and if so the breaker may be operated via either actuator.

18 Claims, 5 Drawing Sheets

(56) References Cited

OTHER PUBLICATIONS

Wu et al. "A New Thomson Coil Actuator: Principle and Analysis" IEEE Transactions on Components, Packaging and Manufacturing Technology 5(11):1644-1654 (2015).
Park et al. "Dynamic Analysis of Thomson Coil Actuator for Fast Switch of HVDC Circuit Breaker" IEEE Switching Technology, pp. 425-430 (2015).

* cited by examiner 120
124
230
G6
114
110
G3
130
G2

128
120
124
222
G3
240
G5
114
G2
220
200
130
110

120
124
G4
114
110
G1
130

120
124
G1
170
160
164
162
150
140
114
110
122
134
136
130
132
118
112

COMPACT POLE UNIT FOR FAST SWITCHES AND CIRCUIT BREAKERS

BACKGROUND

This patent document relates to circuit breakers found in an electrical disconnect switch, and it more particularly relates to improved circuit breakers employing fast switches to open vacuum interrupters at high speeds.

Vacuum interrupters are typically used to interrupt electric current flows. The interrupters include a generally cylindrical vacuum envelope surrounding a pair of coaxially aligned separable electrode assemblies having opposing contact surfaces. The contact surfaces abut one another in a closed circuit position and are separated to open the circuit. Each electrode assembly is connected to a current carrying terminal post that extends outside the vacuum envelope and connects to an electrical circuit. One or more actuators open the circuit by pulling the electrode assemblies apart, typically by pulling a movable electrode assembly away from a fixed electrode assembly.

In high voltage electrical systems such as those that exist in large power plants (typically over 100 MW), the vacuum interrupters that are used in such systems are subject to high rated currents and high interruption currents. The performance requirements needed for these circuit breakers present significant design challenges, as the high rated current requires large contact force and electrode size to keep the temperature rise low at the electrode terminals. Larger electrode assemblies open slower with conventional actuators, which may typically separate an electrode assembly pair on the order of 50 ms for an interruption gap distance that is sufficient to interrupt an electrical circuit (such as 5 mm).

These vacuum interrupters are typically incorporated within a pole unit having a drive rod interconnecting a movable electrode assembly to an actuator. The drive rod may have a contact spring to assist returning the movable electrode assembly back into abutting contact with the fixed electrode assembly.

The most common way to solve the above-noted problems is to employ faster actuators (such as fast switches) to separate the electrode assembly pair within a pole unit, thereby obtaining separation times on the order of 0.5 ms. A class of fast switches known as ultra-fast actuators are able to transition from closed to fully open in under 2 ms. Ultra-fast acceleration requires a rigid and strong body structure to withstand high G-forces and to obtain instant response. This however has the undesired effects of accelerating a large mass over a short distance which requires materials strength design considerations for components of the pole unit. It is therefore desirable to obtain a compact pole unit having a reduced mass of the drive rod to provide a compact and light-weight design.

This document describes a novel solution that addresses at least some of the issues described above.

SUMMARY

In various embodiments, a circuit breaker includes a compact pole unit. The pole unit includes an encapsulated body having a first end, a second end and an outer surface. One or more rings extend from the encapsulated body on the outer surface. A first conducting terminal and a second conducting terminal also each extend from the encapsulated body. A vacuum interrupter is positioned within the encapsulated body. The vacuum interrupter includes a vacuum enclosure, a movable first electrode assembly having a first stem that slidably extends from the vacuum enclosure and that is slidably connected to the first conducting terminal, and a second electrode assembly having a second stem extending from the vacuum enclosure and connected to the second conducting terminal. A drive rod interconnects the first actuator to the first stem at the first end of the compact pole unit. The circuit breaker also includes a coupler assembly, which in some embodiments may be integrated into the pole unit. The coupler assembly includes a contact spring positioned at the second end of the compact pole unit, as well as a plunger. The circuit breaker also includes a first actuator at the first end of the compact pole unit, and optionally a second actuator at the second end of the compact pole unit. If the circuit breaker includes a second actuator, the second actuator will be connected to the contact spring of the coupler assembly via the contact spring.

The rings may be configured to extend creeping distances between any high voltage sources and any grounding locations.

The first actuator may be configured to operate at an opening velocity that is greater than an opening velocity of the second actuator.

In some embodiments, the coupler assembly may include a casting cup. If so, the contact spring may be positioned within the casting cup.

Optionally, in embodiments that include a casting cup, the coupler assembly also may include a cap screw that comprises an aperture and that is threaded into the casting cup. The plunger of the coupler assembly may include a piston and a connector end, so that the piston of the plunger is positioned adjacent the contact spring, and the connector end of the plunger extends through the aperture of the cap screw. Alternatively, the plunger may include a guide, the contact spring may include a central opening; and the guide of the plunger may extend though the central opening of the contact spring.

Optionally, in embodiments that include a casting cup, the casting cup may include an abutment surface, the plunger may include a piston, and the contact spring may be positioned between the piston of the plunger and the abutment surface of the casting cup. If so, then the plunger also may include a guide, positioned such that movement of the guide is limited by the abutment surface of the casting cup.

Optionally, in embodiments that include a casting cup, the casting cup may be an integral portion of the encapsulated body.

Optionally, the first actuator may be positioned at a first end of the compact pole unit, and the second actuator may be positioned at a second end of the compact pole unit, to provide a circuit breaker that is operable from either the first end or the second end.

BRIEF DESCRIPTION OF THE DRAWINGS

FIG. 1A illustrates an isometric view of a circuit breaker, while

FIG. 2A illustrates an exploded view of a coupler assembly, while

FIG. 3 illustrates a closed configuration (normal conduction). FIG. 4 illustrates an initial open (instant interruption) position. FIG. 5 illustrates a continuous open (increased interruption) position. FIG. 6 illustrates a fully open (isolation) position.

DETAILED DESCRIPTION

Terminology that is relevant to this disclosure is provided at the end of this detailed description. The illustrations are not to scale.

Figure 1A:
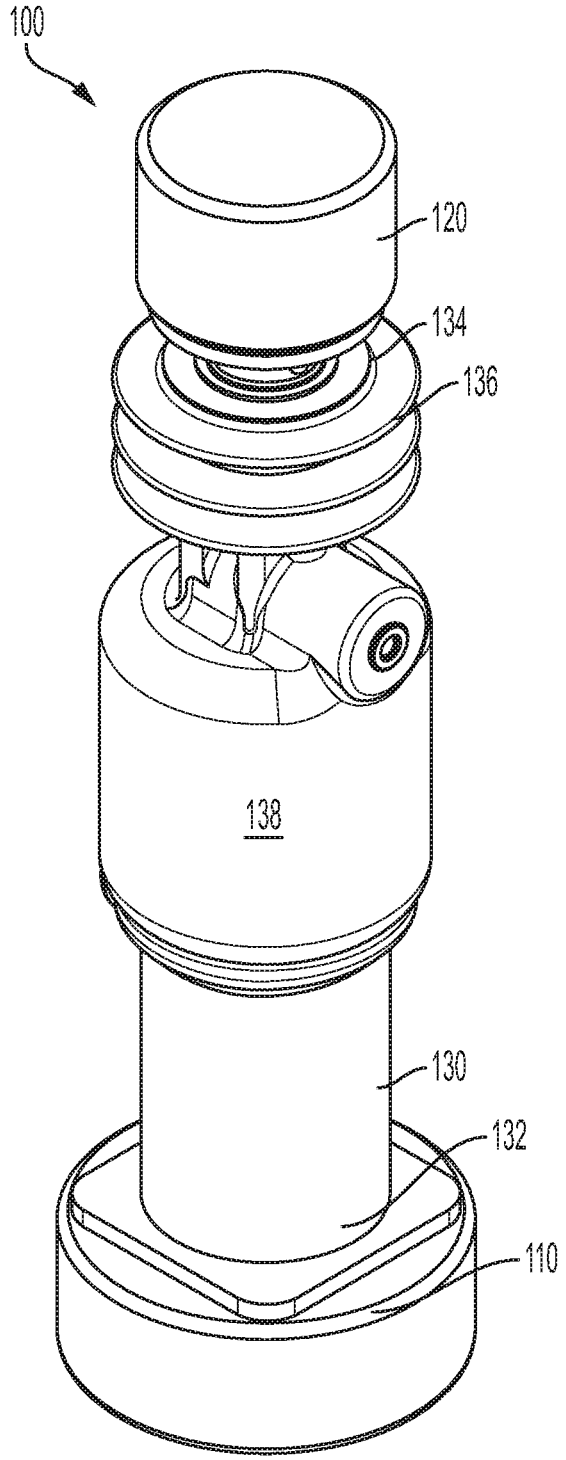
Figure 1B:
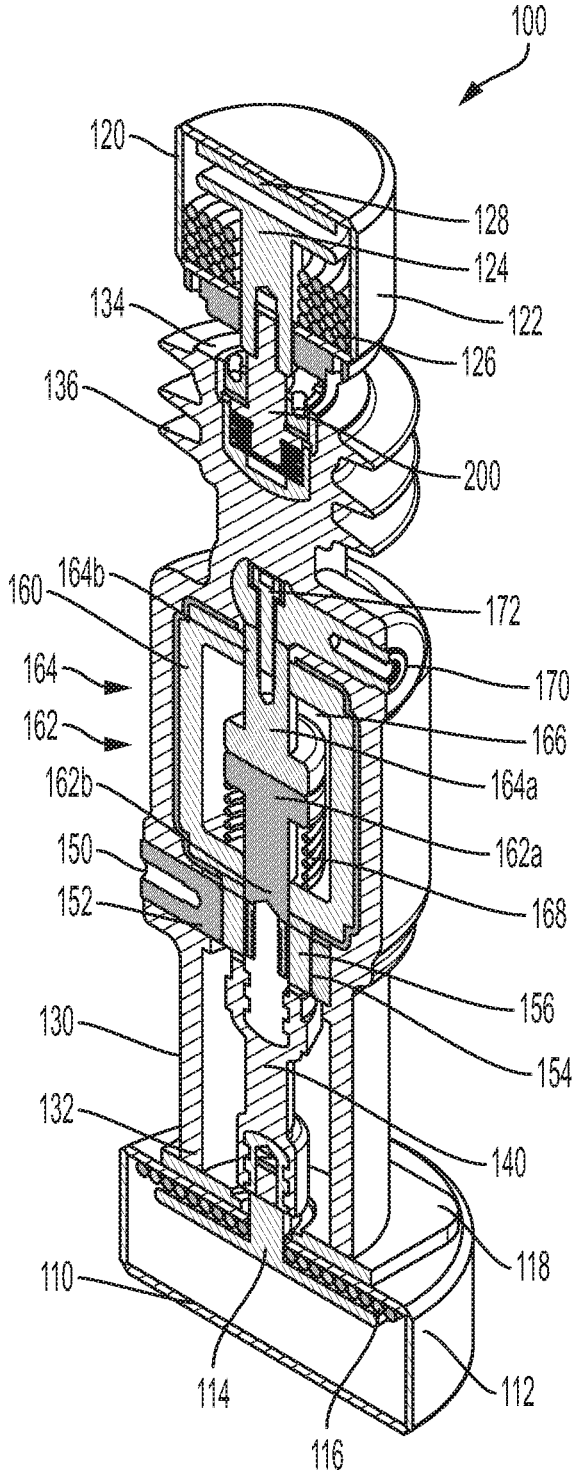
FIG. 1B illustrates an isometric sectional view of the circuit breaker of FIG. 1A.

FIG. 1A illustrates an isometric view of a circuit breaker 100, while FIG. 1B illustrates an isometric sectional view of the circuit breaker 100 of FIG. 1A.

The circuit breaker 100 may include a first actuator 110, a second actuator 120, and a pole unit body 130. Alternatively, the circuit breaker 100 may contain only one actuator 110 with the other end of the pole unit body 130 connected to a fixed object. The first actuator 110 may be an ultra-fast actuator, as will be described in more detail below.

The pole unit body 130 may have a first end 132 and a second end 134. The first end 132 and/or the second end 134 may include extended rings 136 formed on the outer housing of pole unit body 130 to extend—and thus create relatively longer—creeping distances between any high voltage sources and any grounding locations than would exist without the rings. The extended rings 136 may be located on the outer surface 138 of the pole unit body 130 such that any discharging electrical arc may be exposed to the surrounding environment and may be discharged away from the pole unit body 130. The pole unit body 130 may contain circuit breaker components within its perimeter. For example, the pole unit body 130 may contain a drive rod 140, a first conducting terminal 150, a vacuum interrupter 160, a second conducting terminal 170, and a coupler assembly 200. The pole unit body 130 may have a compact size and provide an encapsulation of some circuit breaker components. For example, the first conducting terminal 150, vacuum interrupter 160, second conducting terminal 170, and coupler assembly 200 may be encapsulated within the pole unit body 130.

The first actuator 110 may include components such as a solenoid cylinder 112, piston 114, and coil 116. An abutment surface 118 of the solenoid cylinder 112 may provide a surface limiting the first end 132 of the pole unit body, as will be described below.

The vacuum interrupter 160 may include a first electrode assembly 162, a second electrode assembly 164, and a vacuum enclosure 166 (such as an envelope) having a bellows 168. The first electrode assembly 162 may include a movable contact 162*a* and a movable stem 162*b* slidably extending from the vacuum enclosure 166 and slidably connected to the first conducting terminal 150. The second electrode assembly 164 may include a contact 164*a* and a stem 164*b* fixedly extending from the vacuum enclosure 166 and connected to the second conducting terminal 170. The second electrode assembly 164 may be considered to be a fixed electrode assembly if its stem 164*b* is fixedly attached to the second conducting terminal 170. However, in the overall context of the circuit breaker 100, the second electrode assembly 164 may move in response to activation by the second actuator 120.

The drive rod 140 may connect the first electrode assembly 162 of the vacuum interrupter 160 to the piston 114 of the first actuator 110. The first actuator 110, upon receiving a signal from a controller, may retract the piston 114 from an extended first position (see FIGS. 3 and 6) to a retracted second position (see FIGS. 4 and 5). Retracting the piston 114 of the first actuator 110 may pull the movable contact 162*a* away from the fixed contact 164*a*, as will be described in more detail below.

The first conducting terminal 150 may include a post 152 having an aperture 154 and a movable connector 156 having a sliding spring contact (not shown). The movable connector 156 may move with the first electrode assembly 162 while the internal spring contact maintains an electrical connection between the movable connector 156 and the inner surface of the aperture 154 of the post 152. A conductive electrical path is maintained between the first conducting terminal 150 and the vacuum interrupter 160 during operations of the circuit breaker 100.

The second conducting terminal 170 may be connected to the second electrode assembly 164 of the vacuum interrupter 160. For example, a threaded connector 172 (such as a screw) may pass through the second conducting terminal 170 and thread into the stem 164*b*. A conductive electrical path is maintained between the second conducting terminal 170 and the vacuum interrupter 160 during operations of the circuit breaker 100.

The second actuator 120 may include components such as a solenoid cylinder 122, piston 124, coil 126, and magnet 128.

Figure 2A:
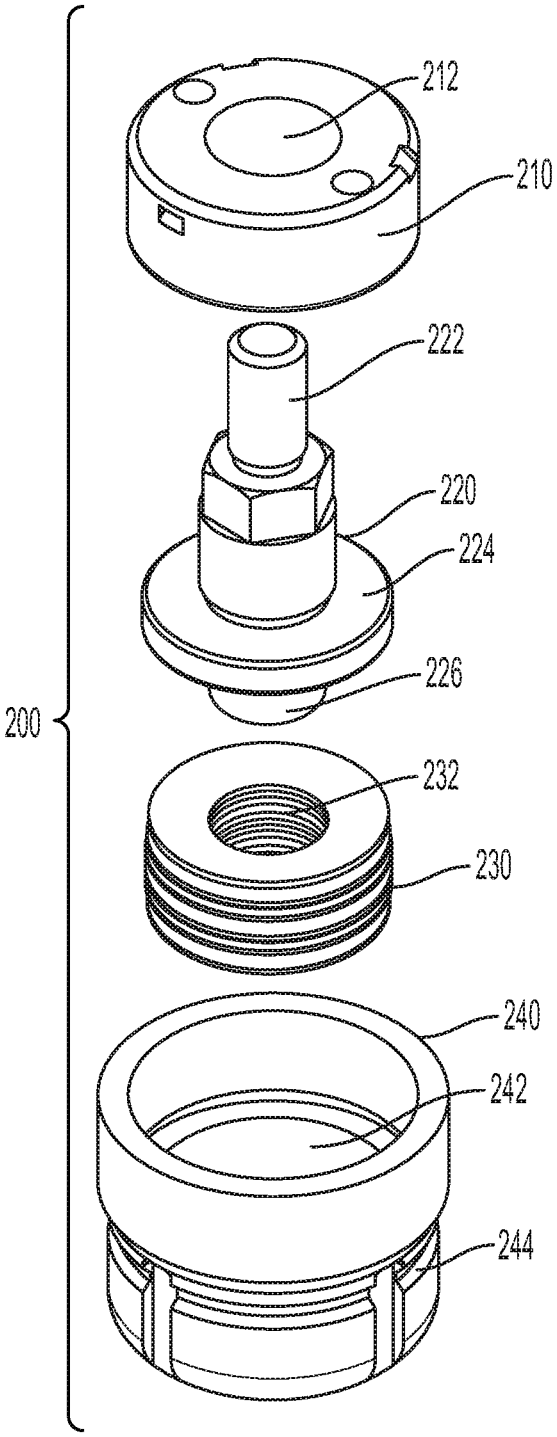
Figure 2B:
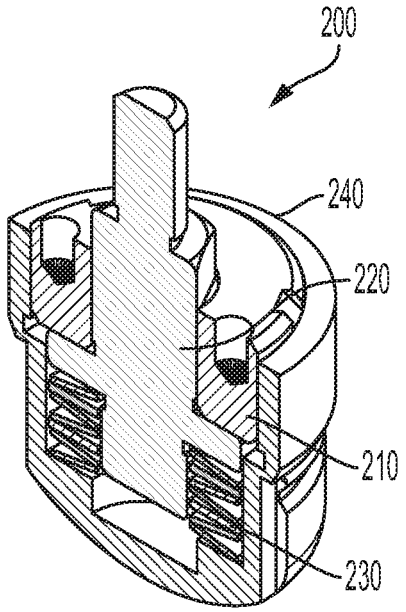
FIG. 2B illustrates an isometric sectional view of the coupler assembly of FIG. 2A.

A coupler assembly 200 may couple the second end 134 of the pole unit body 130 to the second actuator 120. FIG. 2A illustrates an exploded view of an example coupler assembly 200 according to an embodiment of the disclosure, while FIG. 2B illustrates an isometric sectional view of the coupler assembly 200 of FIG. 2A. The coupler assembly 200 may be a contact spring assembly that includes a cap screw 210, plunger 220, contact spring 230, and casting cup 240. The coupler assembly 200 may be an integral portion of the pole unit body 130 as shown in the enclosed figures. With this configuration, it is not required to integrate a coupler spring assembly with the drive rod 140 as is typical on conventional breaker pole unit designs.

The casting cup 240 may have an open end 242 for receiving the contact spring 230 and a first portion of the plunger 220. The cap screw 210 may include an aperture 212 for allowing a second portion of the plunger 220 to extend from the casting cup 240. The cap screw 210 may enclose the open end 242 of the casting cup 240. The casting cup 240 may optionally include annular grooves 244 for mating with matching rings in an opening of the second end 134 of the pole unit body 130. Other fastening techniques may be used to connect the coupler assembly 200 to the second end 134 of the pole unit body 130. Alternatively, the casting cup 240 may be an integral portion of the pole unit body 130.

The plunger 220 may include a connector end 222, a piston 224, and a guide 226. The connector end 222 of the plunger 220 may pass through the aperture 212 of the cap screw 210 and connect directly to the second actuator 120. For example, the connector end 222 of the plunger 220 may thread into an opening in the piston 124 of the second actuator 120. Other methods of connection are also possible. The second actuator 120, upon receiving a signal from a controller, may retract the piston 124 from an extended first position (see FIGS. 3 and 4) to a retracted second position (see FIGS. 5 and 6). Retracting the piston 124 of the second actuator 120 may pull the pole unit body 130 away from the first actuator 110 creating a gap between the pole unit body 130 and the first actuator 110 a spacing distance $G_2$, as will be described in more detail below. Alternatively, the connector end 222 of the plunger 220 may be fixed. For example, the connector end 222 may be fixed to a housing, such as an internal wall or mounting feature of a cabinet housing of the disconnect switch.

The piston 224 of the plunger 220 may compress the contact spring 230 against the inner surface of the casting cup 240 during operation of the first actuator 110 and/or second actuator 120, as will be described below. The guide 226 of the plunger may ensure the proper compression of the contact spring 230. For example, the contact spring 230 may be a collection of biased springs (such as Belleville washers) having aligned central openings 232 such that the guide 226 of the plunger 220 may pass through the central openings 232 during compression of the contact spring 230.

A disconnect switch may also include a support member for the first actuator 110 and a support member for the second actuator 120. The support members may be stationary and coupled to a housing, such as an internal wall or mounting feature of a cabinet housing of the disconnect switch.

FIGS. 3-6 are front sectional views of an example circuit breaker 100 in four different operational positions according to embodiments of the present disclosure. The second actuator may be configured to move a greater mass than the first actuator. The second actuator may provide a motive force resulting in a slower velocity provided by the motive force of the first actuator. For example, the circuit breaker 100 shown in FIGS. 3-6 may have an ultra-fast first actuator 110. The ultra-fast first actuator 110 may completely move the piston 114 from the extended first position to the retracted second position at a time period of about 0.5 milliseconds (ms) to about 3 ms. The second actuator 120 may completely move the piston 124 from the extended first position to the retracted second position at a time period of about 10 ms to about 40 ms. The velocity of the ultra-fast first actuator 110 compared to the velocity of the second actuator 120 may be on the order of one-hundred times faster (0.5 ms compared to 50 ms for the same distance).

Figures 3, 4, 5, 6:
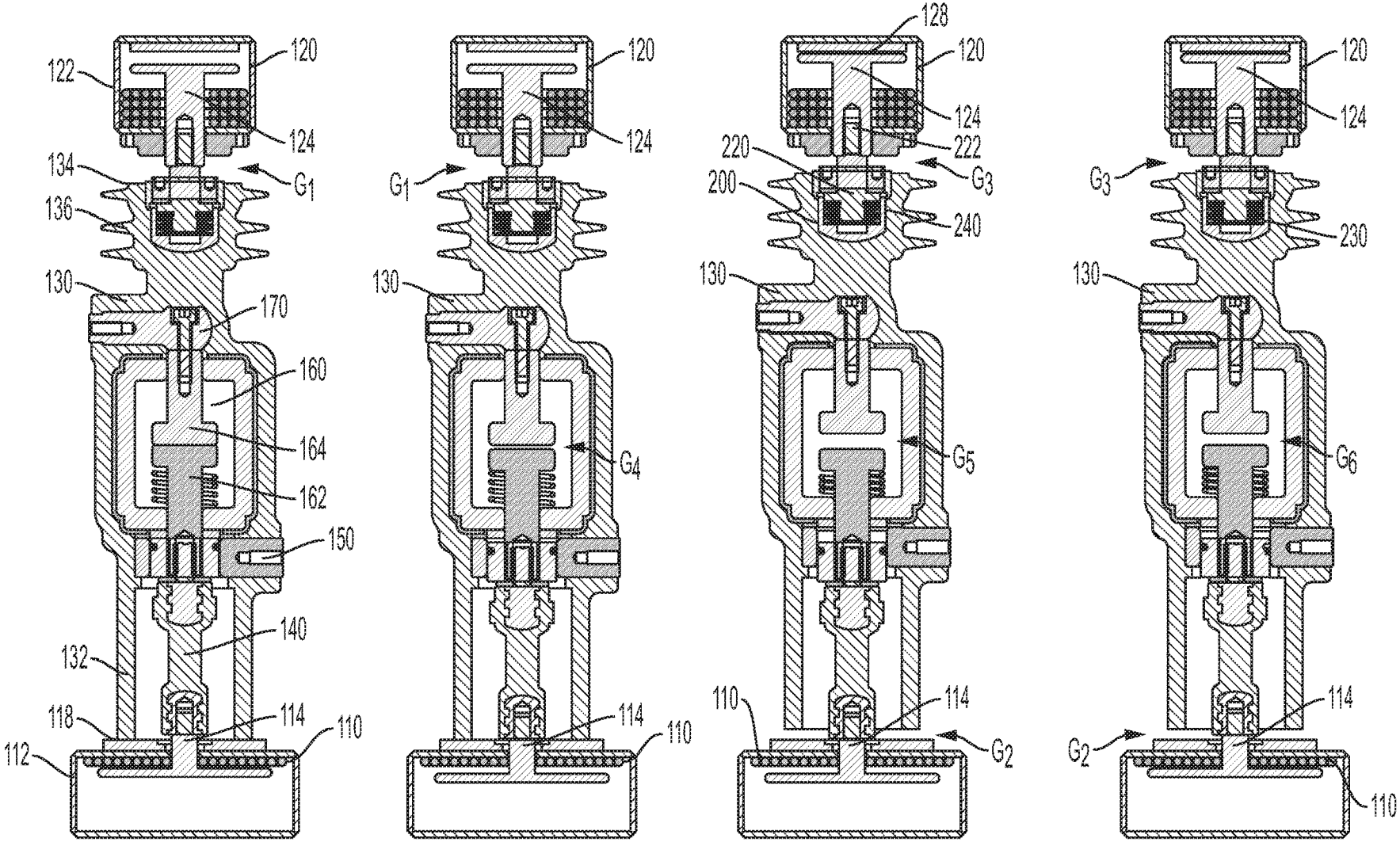
FIGS. 3-6 are front sectional views of an example circuit breaker in four different operational positions according to embodiments of the present disclosure.

FIG. 3 illustrates a closed configuration of the movable contact 162*a* pressing against the fixed contact 164*a* within the vacuum interrupter 160 during normal operations. This closed configuration creates a normal conduction path between the first conducting terminal 150 and the second conducting terminal 170. The ultra-fast first actuator 110 and second actuator 120 may be fixed within a switching device frame (not shown) and may be connected to a controller (not shown) for signaling the need to break the conduction path (such as a circuit breaker operation). The first end 132 of the pole unit body 130 presses against the abutment surface 118 on the solenoid cylinder 112 of the ultra-fast first actuator 110 during normal operations. The second end 134 of the pole unit body 130 is spaced a gap distance $G_1$ from the second actuator 120 when the contacts 162, 164 are closed.

Upon receiving a signal from a controller, the ultra-fast first actuator 110 and second actuator 120 begin to move the pistons 114 and 124, respectively, apart in opposite directions. FIG. 4 illustrates an initial open position when the piston 114 of the ultra-fast first actuator 110 reaches the fully retracted second position, while the piston 124 of the second actuator 120 is still in motion from the extended first position to the retracted second position. The travel distance of the piston 124 of the second actuator 120 is negligible compared to the fully retracted distance of the piston 114 of the ultra-fast first actuator 110 to reach the initial open position.

The piston 114 connected to the first electrode assembly 162 via the drive rod 140 pulls the movable contact 162*a* apart from the fixed contact 164*a* to a spacing distance $G_4$ to create an instant interruption in the conductive path. The spacing distance $G_4$ may be about 1 mm to about 2 mm. The initial open position may occur at approximately 0.5 ms after receiving the circuit breaking signal from the controller.

The piston 124 of the second actuator 120 continues to travel to the fully retracted second position. The piston 124 of the second actuator 120 is directly connected to the connector end 222 of the plunger 220 in the coupler assembly 200. As the piston 124 travels to the retracted second position, the piston 224 of the plunger 220 presses against the cap screw 210, which is connected to the casting cup 240 of the coupler assembly 200. The pole unit body 130 being connected to the coupler assembly 200 is also drawn closer to the second actuator 120. The second electrode assembly 164 within the vacuum interrupter 160 being fixed to the pole unit body 130 is likewise drawn closer to the second actuator 120.

As the piston 124 of the second actuator 120 retracts, the first end 132 of the pole unit body 130 is pulled away from the abutment surface 118 on the solenoid cylinder 112 of the ultra-fast first actuator 110 to a spacing distance $G_2$ while drawing the second end 134 of the pole unit body 130 toward the fixed solenoid cylinder 122 of the second actuator 120 to a spacing distance $G_3$. Spacing distance $G_3$ is less than spacing distance $G_1$.

FIG. 5 illustrates a continuous open position when the piston 124 of the second actuator reaches the fully retracted second position. The magnet 128 within the second actuator 120 may maintain the piston 124 in the fully retracted second position. The fixed contact 164*a* being connected to the pole unit body 130 is drawn apart even further from the movable contact 162*a* a spacing distance $G_5$ to create an increased interruption in the conductive path. The spacing distance $G_5$ may be about 5 mm to about 6 mm. The continuous open position occurs at approximately 25 ms after receiving the circuit breaking signal from the controller.

FIG. 6 illustrates a fully open position. After completely interrupting the conductive path (such as breaking the circuit), the piston 114 of the ultra-fast first actuator 110 returns to the extended first position while maintaining the spacing distance $G_2$ between the first end 132 of the pole unit body 130 from the abutment surface 118 on the solenoid cylinder 112 of the ultra-fast actuator 110 and the spacing distance $G_3$ between the second end 134 of the pole unit body 130 and the fixed solenoid cylinder 122 of the second actuator 120. As the piston 114 of the ultra-fast first actuator 110 returns to the extended first position, the connected movable contact 162*a* moves closer to the fixed contact 164*a* a spacing distance $G_6$ to create an isolation in the conductive path. The spacing distance $G_6$ may be about 4 mm to about 5 mm. The fully open position occurs after approximately 25 ms after receiving the circuit breaking signal from the controller.

To return the interrupted conductive path to normal operations, the controller may signal the second actuator 120 to release the retracted piston 124 to the extended first position. The plunger 220 presses the contact spring 230 within the coupler assembly 200 which further presses against the casting cup 240 biasing the pole unit body 130 to return to pressed contact against the abutment surface 118 on the solenoid cylinder 112 of the ultra-fast actuator 110 (such that $G_2=0$) while the movable contact 162*a* returns to pressed contact against the fixed contact 164*a* within the vacuum interrupter (such that $G_4=G_5=G_6=0$). This returns the circuit breaker 100 to the fully closed position (see FIG. 3).

Embodiments of the disclosure may move the first electrode assembly 162 at a fast velocity from a closed position (see FIG. 3) to the initial interruption gap $G_4$ (see FIG. 4), followed by a slower velocity provided by the second actuator 120 in an opposing direction from the first actuator 110 to an increased interruption gap $G_5$, and followed further by the returning first actuator 110 to the isolation gap $G_6$.

In the embodiments shown with two actuators, one at each end of the pole unit, the breaker is configured to be operated from either end, unlike conventional breakers. The first actuator 110 may have a different configuration than the second actuator 120 and may provide a motive force to move the first electrode assembly 162 to the initial interruption gap position $G_4$, after which the first actuator 110 may stop providing its motive opening force. The first actuator 110 may include, for example, a Thompson coil or piezoelectric actuator. Other types of actuators may be used, alone or in combination. The first actuator 110 may be any type of actuator that is fast enough to establish the initial interruption gap $G_4$ in a suitable velocity. Examples, include, but are not limited to, electromagnetic, solenoid, motor, permanent magnet, pneumatic, hydraulic, electro-rheological, magneto-rheological, magnetostriction, linear or rotary versions of these. For a discussion of Thompson coil designs, see Peng et al., Evaluation of Design Variables in Thompson Coil based Operating Mechanisms for Ultra-Fast Opening in Hybrid AC and DC Circuit Breakers, *IEEE Applied Power Electronics Conference and Exposition*, pages 2325-2332 (2015); Peng et al., A Fast Mechanical Switch for Medium Voltage Hybrid DC and AC Circuit Breakers, *IEEE Transactions on Industry Applications* 52(4):2911-2918 (2015); Wu et al., A New Thomson Coil Actuator: Principle and Analysis, *IEEE Transactions on Components, Packaging and Manufacturing Technology* 5(11):1644-1654 (2015). For a discussion of a piezoelectric actuator, see Bosworth et al., High Speed Disconnect Switch with Piezoelectric Actuator for Medium Voltage Direct Current Grids, *IEEE Electric Ship Technologies Symposium*, pages 419-423 (2015). The contents of these documents are hereby incorporated by reference as if recited in full herein.

The second actuator 120 may include, for example, an electromagnetic actuator, a solenoid type actuator, a rheostat type actuator, a pneumatic actuator, a spring actuator, a motor actuator or a hydraulic actuator. Other types of actuators may be used. The second actuator 120 may be a single actuator or a single type of actuator or a plurality of cooperating actuators of the same type or of different types.

In some embodiments, $G_4$ is a range of 1 mm to 3 mm, more typically in a range of about 1 mm and about 2 mm. The first actuator 110 may provide the $G_4$ spacing in less than or equal to about 3 ms, such as 3 ms, 2.5 ms, 2 ms, 1.5 ms, 1 ms, and 0.5 ms or even less. The first actuator 110 may provide the only motive force to move the first electrode assembly 162 to the initial separation gap, $G_4$, in less than 3 ms.

In some embodiments, $G_5$ is in a range of 5 mm to 15 mm, such as 5 mm, 6 mm, 7 mm, 8 mm, 9 mm, 10 mm, 11 mm, 12 mm, 13 mm, 14 mm and 15 mm. To be clear, $G_5=G_4+G_2$, where $G_2$ is the distance the pole unit body 130 moves.

The second actuator 120 may move the pole unit body 130 a distance $G_2$ that is in a range of 3 mm to 15 mm, more typically a range of 4 mm to 8 mm, in a direction opposite the first actuator 110, typically in a time period of 10 ms to 85 ms, more typically in a time period of 20 ms to 50 ms, 20 ms to 40 ms, or 20 ms to 30 ms.

In some embodiments, $G_6$ is in a range of 4 mm to 15 mm, such as approximately 4 mm, 5 mm, 6 mm, 7 mm, 8 mm, 9 mm, 10 mm, 11 mm, 12 mm, 13 mm, 14 mm or 15 mm. To be clear, $G_6=G_5-G_4$.

The speed to close the contacts 162*a*, 164*a* is typically of no urgency and each of the first and second actuators 110, 120 may serially or concurrently cooperate to close the contacts 162*a*, 164*a* to the closed position.

During the opening event, a controller may direct the first actuator 110 to actuate and may direct the second actuator 120 to actuate, typically concurrently. The first actuator 110 may be configured to move the first electrode assembly 162 at a first velocity. The second actuator 120 may be configured to move the pole unit body 130 at a slower velocity relative to the first velocity of the first actuator 110. The controller may include at least one processor (i.e., digital signal processor). The controller may be onboard the circuit breaker 100 and may be in communication with sensors and/or current transformers that may engage stabs of switchgear to measure current occurring during an opening, closing or shorting event, for example.

During the opening event, the first and second actuators 110, 120 may operate sequentially or concurrently. The first actuator 110 may apply a respective motive force serially or concurrently with the second actuator 120. The first actuator 110 may stop applying a motive force, once the initial interruption gap $G_4$ is achieved and/or prior to the second actuator 120 applying its motive force during an opening event.

The second actuator 120 may move the pole unit body 130 away from the first actuator 110 and provide the gap space $G_2$ between the first end 132 of the pole unit body 130 and the first actuator 110 when in a fully open status.

In contemporary AC circuit breakers, the opening and closing times are in the range of 30 ms to 85 ms, out of which an actual arcing time is ½ to 1 cycle of the AC current, i.e., 16 ms in the U.S. with 60 Hz frequency or 20 ms in other countries of the world. Embodiments of the present invention provide the initial interruption position in under 3 ms, such as in 0.5 ms to 2 ms, or such as 0.5 ms to 1 ms or less, followed by an isolation gap $G_6$ in the range of 20 ms to 50 ms, such as 20 ms to 40 ms, or such as 20 ms to 30 ms.

Figure 7:
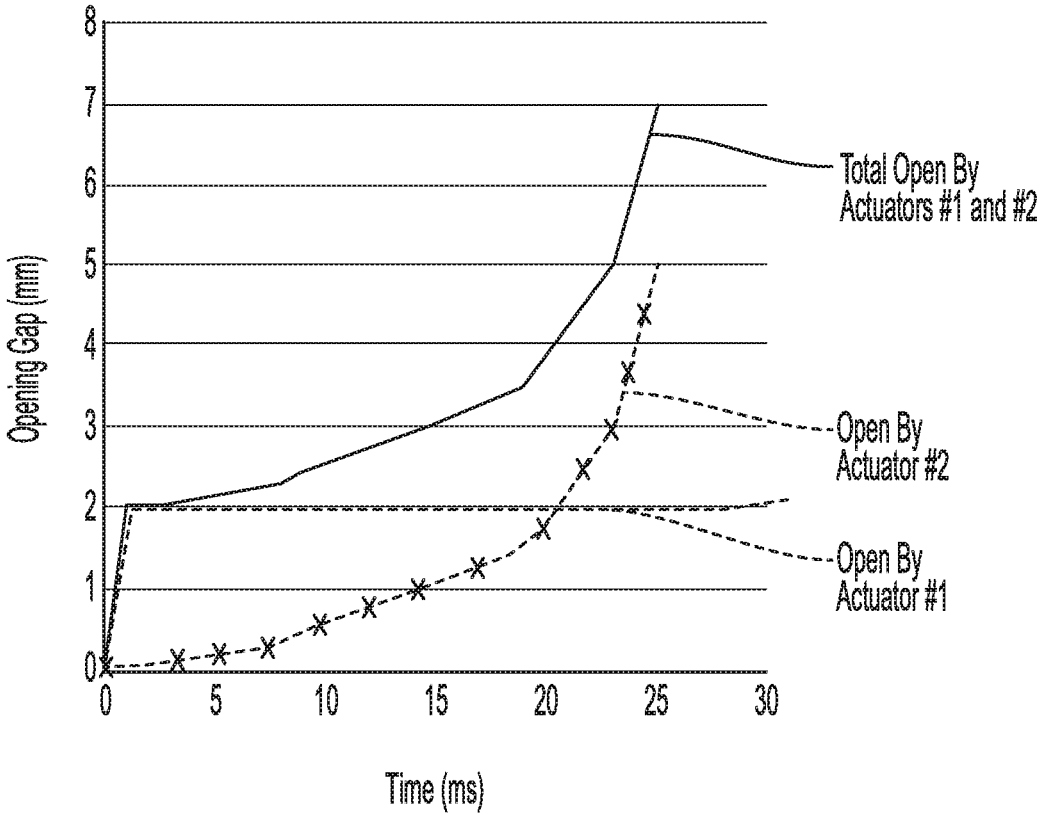
FIG. 7 is a timing graph of an example opening operation of distance (mm) versus time (ms) according to embodiments of the present disclosure.

FIG. 7 is a timing graph of an example opening operation of distance (mm) versus time (ms) according to embodiments of the present disclosure. The first actuator (middle dashed line) provides an opening gap distance $G_4$ of about 2 mm in about 2 ms or less, then stops and does not provide further motive force for opening. The second actuator (lowest line marked with the "x" delineation) initiates opening movement (in an opposing direction as the first actuator) at the same time as the first actuator or within 2 ms thereof and continues to operate to provide an opening gap distance $G_6$ of about 5 mm. In total, the first and second actuators cooperate to provide a cumulative opening gap distance $G_5$ of about 7 mm (upper solid line). These are example opening gap distances and opening times. Other opening gap distances and opening times may be achieved.

Thus, in some embodiments, the first and second actuators, respectively, may receive an open command simultaneously and may respond simultaneously. For example, the first actuator may move faster and reach a 2 mm contact gap (initial interruption) in 1 ms (or less) in one direction, then stops at 2 mm. The second actuator may move slower than the first actuator and may open the contact gap to 5 mm in 25 ms in an opposing direction, then it stops there. The first and second actuators may provide a total contact opening gap (isolation gap) of 7 mm in 25 ms in this example.

Figure 8:
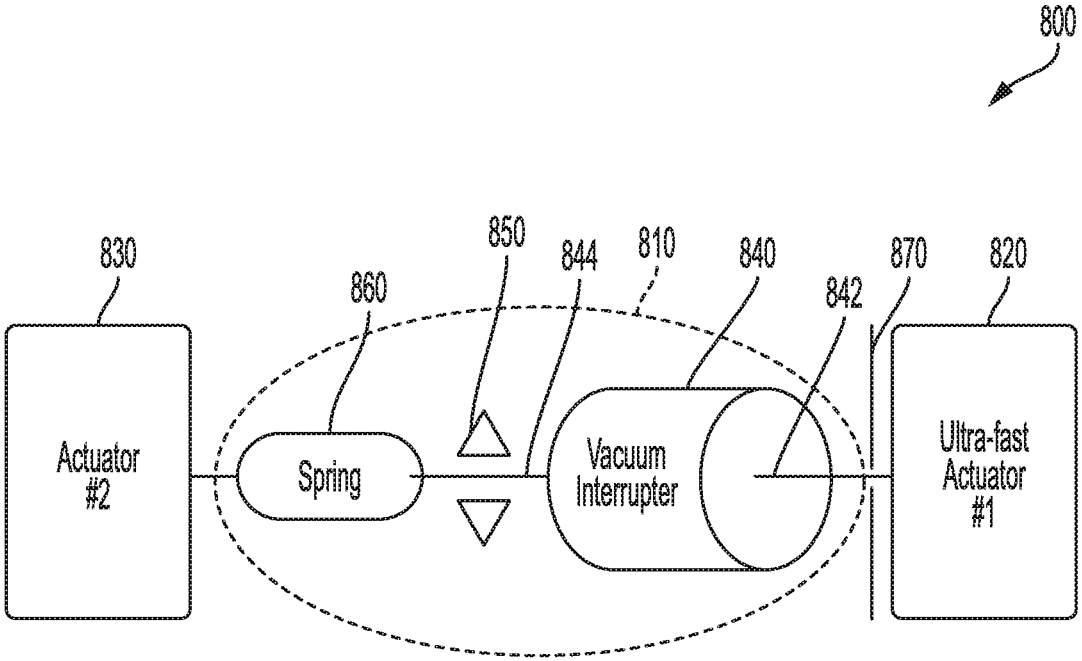
FIG. 8 illustrates a block diagram of an example circuit breaker.

FIG. 8 illustrates a block diagram of an example circuit breaker 800. The circuit breaker 800 may include a compact pole unit 810, an ultra-fast first actuator 820, and a second actuator 830. The compact pole unit 810 may contain (such as by encapsulation), for example, a vacuum interrupter 840, an adjustable moving mass 850, and a contact spring 860. The vacuum interrupter 840 may include a movable electrode 842 and a fixed electrode 844. The vacuum interrupter 840 may connect, disconnect, and isolate a circuit upon command from a controller.

The contact spring 860 may act upon (such as by pushing on) a fixed end of the vacuum interrupter 840 to provide the required contact force within the vacuum interrupter 840 to close the gap between the movable electrode 842 and the fixed electrode 844 to close the circuit (such as reestablishing the circuit). By placing the contact spring 860 on the fixed end of the vacuum interrupter 840, the fixed end of the vacuum interrupter 840 may be mass-optimized while the movable end of the vacuum interrupter 840 may be mass-minimized. For example, reducing the mass of the movable electrode 842 and/or attached drive rod allows for faster opening operations.

The ultra-fast first actuator 820 may drive the movable electrode 842 to provide a small displacement between the movable electrode 842 and the fixed electrode 844 within the vacuum interrupter 840. The ultra-fast first actuator 820 may provide the small displacement in under 2 ms after receiving an opening command to establish an initial interruption gap. The compact pole unit 810 may press against a position locator 870 to stabilize the vacuum interrupter 840 during this opening movement to assist the quick establishment of the initial interruption gap.

The second actuator 830 may provide a larger opening gap in under 40 ms after receiving an opening command by pulling the entire compact pole unit 810 containing the vacuum interrupter 840 from a fixed end to establish an isolation status that will be able to withstand both a short-time voltage and a lightening impulse voltage. This second actuator 830 may also provide closing, latching, and damping operations for the circuit breaker 800.

The adjustable moving mass 850 may stabilize the body of the vacuum interrupter 840 during the opening operation to assist the quick establishment of the initial interruption gap. This may be achieved with a clutch or a disengaging mechanism.

Circuit breakers employing ultra-fast actuators have the undesired effect of accelerating a large mass over a short distance with further materials strength design considerations for components of the pole unit. By placing the contact spring on the fixed end of the vacuum interrupter, the driven mass of the movable electrode is substantially reduced. This reduction in mass allows for faster actuators, drive rods with reduced size dimensions, and/or a wider range of material strength limits. This also allows for a more compact pole unit having a higher energy efficiency and higher power density.

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

In this document, the term "connected", when referring to two physical structures, means that the two physical structures touch each other. Devices that are connected may be secured to each other, or they may simply touch each other and not be secured.

In this document, the term "electrically connected", when referring to two electrical components, means that a conductive path exists between the two components. The path may be a direct path, or an indirect path through one or more intermediary components.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A circuit breaker, comprising:
- a first actuator;
- a second actuator; and
- a compact pole unit comprising:
  - an encapsulated body having a first end, a second end, and an outer surface,
  - one or more rings extending from the encapsulated body on the outer surface,
  - a first conducting terminal extending from the encapsulated body,
  - a second conducting terminal extending from the encapsulated body,
  - a vacuum interrupter positioned within the encapsulated body, the vacuum interrupter comprising:
    - a vacuum enclosure;
    - a movable first electrode assembly having a first stem slidably extending from the vacuum enclosure and slidably connected to the first conducting terminal;
    - a second electrode assembly having a second stem extending from the vacuum enclosure and connected to the second conducting terminal; and
  - a drive rod interconnecting the first actuator to the first stem at the first end of the compact pole unit; and a coupler assembly comprising:

a contact spring positioned at the second end of the compact pole unit, and a plunger interconnecting the second actuator to the contact spring.

2. The circuit breaker of claim 1, wherein the rings are configured to extend creeping distances between any high voltage sources and any grounding locations.

3. The circuit breaker of claim 1, wherein the first actuator is configured to operate at an opening velocity that is greater than an opening velocity of the second actuator.

4. The circuit breaker of claim 1, wherein:

the coupler assembly further comprises a casting cup; and the contact spring is positioned within the casting cup.

5. The circuit breaker of claim 4, wherein:

the coupler assembly further comprises a cap screw;

the plunger comprises a piston and a connector end;

the cap screw is threaded into the casting cup;

the cap screw comprises an aperture;

the piston of the plunger is positioned adjacent the contact spring; and the connector end of the plunger extends through the aperture of the cap screw.

6. The circuit breaker of claim 4, wherein:

the plunger comprises a piston; and the contact spring is positioned to be compressed against an inner surface of the casting cup.

7. The circuit breaker of claim 4, wherein the casting cup is an integral portion of the encapsulated body.

8. The circuit breaker of claim 1, wherein:

the plunger comprises a guide;

the contact spring comprises a central opening; and the guide of the plunger extends though the central opening of the contact spring.

9. The circuit breaker of claim 1, wherein the coupler assembly is integrated into the compact pole unit.

10. The circuit breaker of claim 1, wherein the first actuator is positioned at a first end of the compact pole unit and the second actuator is positioned at a second end of the compact pole unit to provide a circuit breaker that is operable from either the first end or the second end.

11. A circuit breaker, comprising:

an actuator; and a compact pole unit comprising:

an encapsulated body having a first end, a second end and an outer surface, one or more rings extending from the encapsulated body on the outer surface, a first conducting terminal extending from the encapsulated body, a second conducting terminal extending from the encapsulated body, a vacuum interrupter positioned within the encapsulated body, the vacuum interrupter comprising:

a vacuum enclosure;

a movable first electrode assembly having a first stem slidably extending from the vacuum enclosure and slidably connected to the first conducting terminal; and a second electrode assembly having a second stem fixedly extending from the vacuum enclosure and fixedly connected to the second conducting terminal;

a drive rod interconnecting the actuator to the first stem at the first end of the compact pole unit, and a coupler assembly comprising:

a contact spring positioned at the second end of the compact pole unit; and a fixed plunger biased by the contact spring.

12. The circuit breaker of claim 11, wherein the rings are configured to extend creeping distances between any high voltage sources and any grounding locations.

13. The circuit breaker of claim 11, wherein:

the coupler assembly further comprises a casting cup; and the contact spring is positioned within the casting cup.

14. The circuit breaker of claim 13, wherein:

the coupler assembly further comprises a cap screw;

the plunger comprises a piston and a connector end;

the cap screw is threaded into the casting cup;

the cap screw comprises an aperture;

the piston of the plunger is positioned adjacent the contact spring; and the connector end of the plunger extends through the aperture of the cap screw.

15. The circuit breaker of claim 13, wherein:

the plunger comprises a piston; and the contact spring is positioned to be compressed against an inner surface of the casting cup.

16. The circuit breaker of claim 13, wherein the casting cup is an integral portion of the encapsulated body.

17. The circuit breaker of claim 11, wherein:

the plunger comprises a guide;

the contact spring comprises a central opening; and the guide of the plunger extends though the central opening of the contact spring.

18. The circuit breaker of claim 11, wherein the coupler assembly is integrated into the compact pole unit.

* * * * *